United States Patent [19]

Naveau et al.

[11] Patent Number: 4,995,446

[45] Date of Patent: Feb. 26, 1991

[54] DEVICE FOR COOLING A METAL DURING CASTINGS

[75] Inventors: Paul Naveau, Alleur; Stephan Wilmotte, Chaudfontaine, both of Belgium

[73] Assignee: Centre De Recherches Metallurgigues, Centrum Voor Research In Demetallurgie, Fed. Rep. of Germany

[21] Appl. No.: 306,320

[22] Filed: Feb. 3, 1989

[30] Foreign Application Priority Data

Feb. 3, 1988 [BE] Belgium ..... 08800130

[51] Int. Cl.[5] ..... B22D 11/00

[52] U.S. Cl. ..... 164/437; 164/488; 164/443; 164/485; 222/592

[58] Field of Search ..... 164/437, 443, 485, 488, 164/900; 222/592

[56] References Cited

U.S. PATENT DOCUMENTS

| | | | |
|---|---|---|---|
| 3,570,713 | 3/1971 | Tromel | 222/592 |
| 4,000,771 | 1/1977 | Williamson | 164/437 |
| 4,300,621 | 11/1981 | Wilson | 164/485 |
| 4,580,616 | 4/1986 | Watts | 164/122 |
| 4,582,110 | 4/1986 | Mizotta | 164/443 |
| 4,644,998 | 2/1987 | Mayer | 164/485 |
| 4,679,611 | 7/1987 | Yoshida et al. | 164/443 |
| 4,694,889 | 9/1987 | Spenceley et al. | 164/133 |

FOREIGN PATENT DOCUMENTS

| | | | |
|---|---|---|---|
| 0137435 | 10/1979 | Japan | 164/437 |
| 1400769 | 6/1988 | U.S.S.R. | 164/443 |

*Primary Examiner*—Richard K. Seidel
*Assistant Examiner*—Edward A. Brown

[57] ABSTRACT

The cooling device comprises a supply chamber disposed around a vertical duct and having a front wall which at a spacing intimately follows the shape of the vertical duct, and an evacuation chamber disposed around the supply chamber and separated therefrom by an intermediate wall. The front wall is formed with a number of passages extending towards the vertical duct. Some of these passages open into the supply chamber and the remainder of the passages are connected to tubes which extend through the supply chamber and the intermediate wall and open into the evacuation chamber. The supply chamber comprises means for supplying cooling liquid, and the evacuation chamber comprises means for evacuating cooling liquid.

4 Claims, 2 Drawing Sheets

DEVICE FOR COOLING A METAL DURING CASTINGS

BACKGROUND OF THE INVENTION

1. Field of the Invention

This invention relates to a device for cooling a metal during casting, e.g. for the purpose of casting the metal with practically 0° C. superheat or in the pasty phase into a continuous casting mould.

2. Description of Related Art

The process of casting with approximately 0° C. superheat or in the pasty phase is of known importance in the continuous casting of metals, more particularly steel. In this process, the steel between the casting vessel and the continuous-casting mould is cooled to a temperature near the liquidus temperature or within the solidification range of the steel. The result is at least to eliminate superheating of the steel and, if required, to produce a solidified fraction in the steel, the amount of which depends on the applied cooling. Consequently the steel, at least where it penetrates into the mould; is in a state for obtaining fine, homogeneous structures and reducing segregation in the cast products.

A device for casting a metal with approximately 0° C. superheat or in the pasty phase is disclosed inter alia in patent No. LU-A-86 688. The device basically comprises a vertical duct having external cooling means and a distributor for distributing the cast metal over the inner surface of the vertical duct.

The aim of the invention is to provide a particular device for cooling the metal during casting under optimum conditions.

SUMMARY OF THE INVENTION

Accordingly the invention relates to a device for cooling a metal during casting in a vertical duct, comprising a means for distributing metal over the inner surface of the vertical duct and disposed substantially at the inlet thereof, the device being characterised in that it comprises a supply chamber disposed around the vertical duct and having a front wall which at a distance intimately follows the shape of the vertical duct and an evacuation chamber disposed around the supply chamber and separated therefrom by an intermediate wall, the evacuation chamber being surrounded at the rear by an outer wall, the front wall being formed with a number of passages extending towards the vertical duct, some of the passages opening into the supply chamber, the remaining ones of the passages being connected to tubes which extend through the supply chamber and the intermediate wall and open into the evacuation chamber, the supply chamber comprising means for supplying cooling liquid, and the evacuation chamber comprising means for evacuating the cooling liquid.

In a variant of the device according to the invention, the means for supplying cooling liquid comprise a distribution chamber disposed around the vertical duct and communicating with the supply chamber via a set of channels distributed, preferably uniformly, around the vertical duct.

In a preferred embodiment, the supply chamber and the distribution chamber have at least one common wall portion through which the communication channels are formed.

According to an interesting feature, the passages formed in the front wall of the supply chamber open into the space between the front wall and the vertical duct in a direction perpendicular to the surface of the vertical duct.

Other features and other advantages of the invention will be clear from the description given hereinafter by way of example. The description is of a preferred embodiment of the device according to the invention, as illustrated in the accompanying drawings.

DESCRIPTION OF THE PREFERRED EMBODIMENTS

The two drawings are diagrammatic representations which deliberately show only those components directly necessary for understanding the invention. Analogous or identical components are denoted by the same reference numbers, and the directions of flow of the cooling liquid are indicated by arrows.

Figure 1:
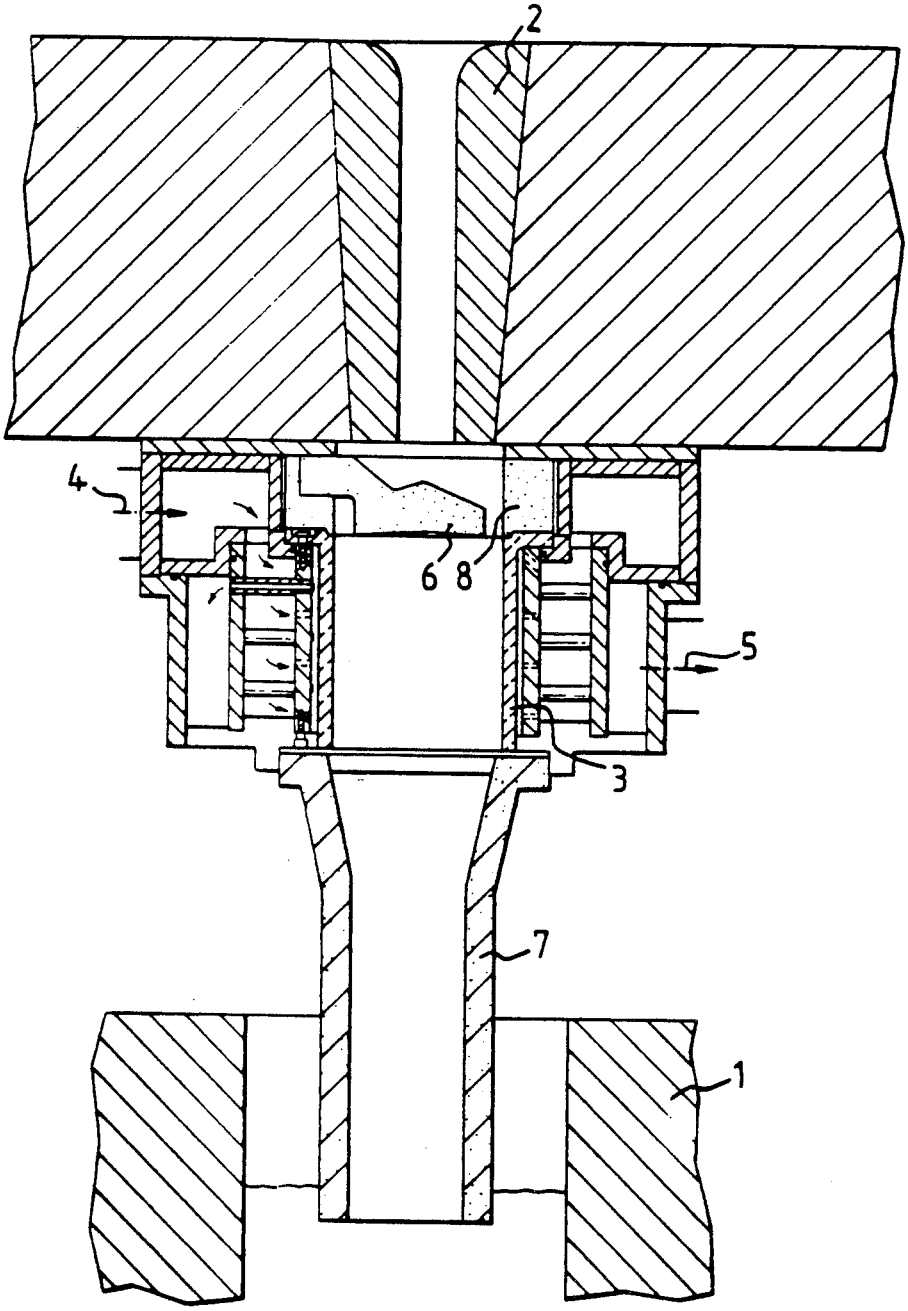
FIG. 1 illustrates a cooling device according to the invention fitted in an installation for casting steel in the pasty phase.

FIG. 1 is a diagram of an installation for casting steel in the pasty phase and equipped with a device for cooling steel according to the invention. An installation of this kind is at present known in the art and will not be described in detail here. It will simply be mentioned that it comprises a continuous casting mould 1, a casting nozzle 2 e.g. on a casting ladle, and a vertical duct 3 disposed upstream of the mould 1 and prolonged by a tubular component 7. The vertical duct 3 is preceded by a refractory portion 8 which also contains a plate 6 borne by three arms and used for distributing the metal. The vertical duct 3 has external cooling means comprising an inlet 4 and an outlet 5 for cooling liquid.

Figure 2:
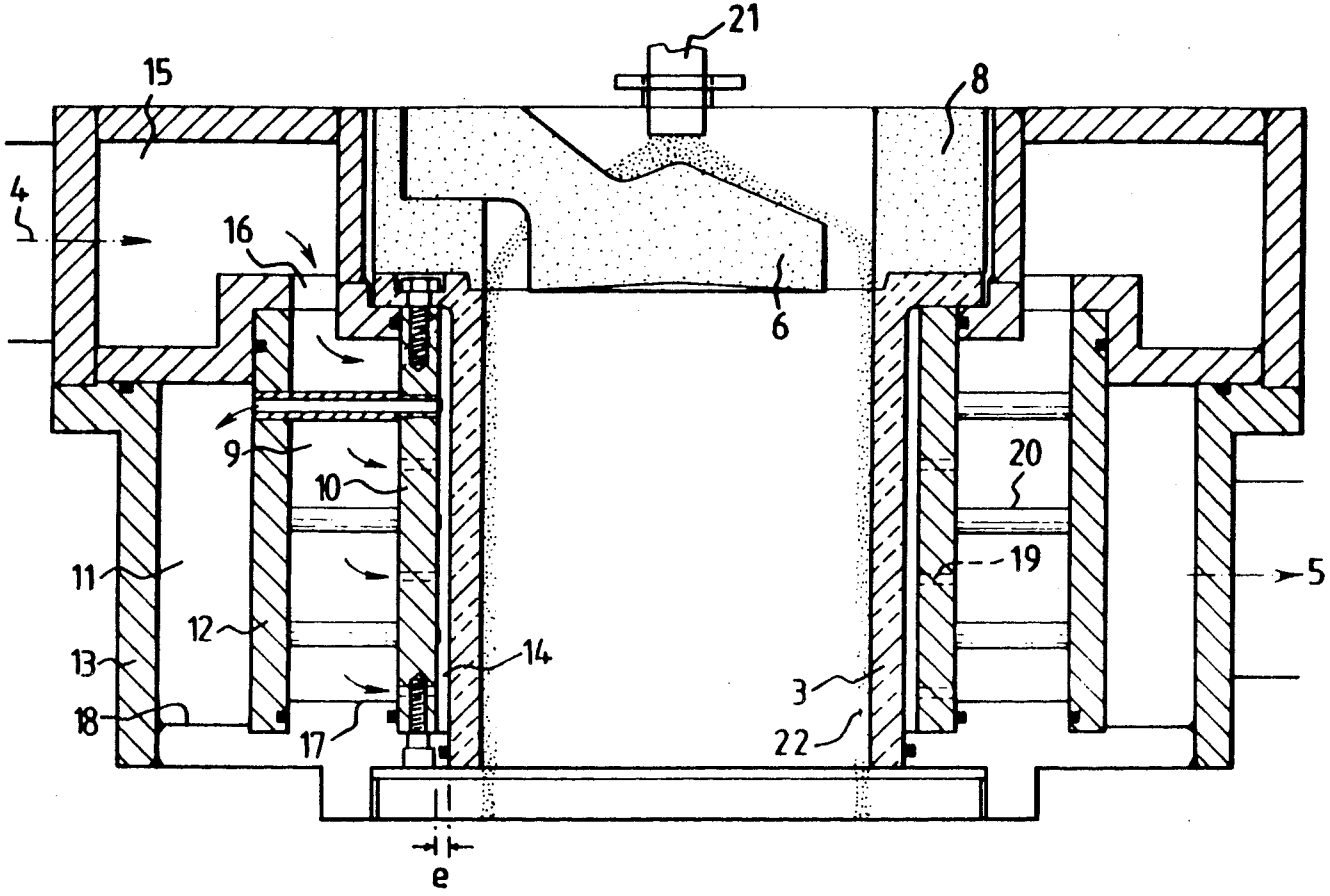
FIG. 2 is a view in lager scale of an axial section of the cooling device in FIG. 1.

The cooling device according to the invention is illustrated on a larger scale in FIG. 2. It comprises a supply chamber 9 disposed around the vertical duct 3 and having a front wall 10 which, at a spacing "e", intimately follows the shape of the vertical duct. The supply chamber 9 is in turn surrounded by an evacuation chamber 11 bounded by an outer wall 13 and also by an intermediate wall 12 which separates it from the supply chamber 9. The distance "e" is the radial width of an annular space 14 formed between the vertical duct 3 and the front wall 10.

A distribution chamber 15 equipped with a cooling liquid inlet 4 is also disposed around the vertical duct 3. The distribution chamber 15 communiucates with the supply chamber 9 via channels 16 formed in a wall portion common to the two chambers 9 and 15. The evacuation chamber 11 has an outlet 5 for the cooling liquid.

At the botton, the supply chamber 9 and the evacuation chamber 11 are closed by individual bases 17 and 18, which prevent the two chambers from communicating.

The front wall 10 is formed with a number of passages which open into the annular space 14 perpendicular to the surface of the vertical duct 3. A part of these passages, denoted by 19, open at their other end inside the supply chamber 9, which is thus connected to the annular space 14. The other passages are connected to return tubes 20 which extend in sealing-tight manner through the supply chamber 9 and intermediate wall 12 and open into the evacuation chamber 11. Chamber 11 is thus directly connected to the annular space 14.

The vertical duct 3 is substantially a circular cylinder. Accordingly, chambers 9, 11, and 15 are toroidal for reasons of symmetry. Also, the passages 19 are preferably uniformly distributed in the front wall 10.

The cooling device according to the invention operates as follows:

A jet of molten steel 21 coming from casting nozzle 2 (not shown in FIG. 2) falls on to the distributing plate 6, from where it flows on to the refractory portion 8 and then in a thin layer 22 along the inner surface of the vertical copper duct 3.

While it is travelling through the vertical duct 3, the steel 22 needs to be cooled until it reaches the pasty state resulting from formation of a solidified fraction.

To this end a cooling liquid, usually water, is introduced under pressure through inlet 4 into the distribution chamber 15, from where it reaches the supply chamber 9 after travelling through channels 16. The cooling liquid flows through passages 19 into the annular space 14, where it flows along the vertical duct 3 before being evacuated through tubes 20. The cooling liquid then reaches the evacuation chamber 11 and escapes therefrom through outlet 5.

Owing to the jets of cooling liquid emerging perpendicularly from passages 19 and the shortness of the path travelled by the liquid between an injection passage 19 and return tubes 20, there is a turbulent flow of cooling liquid in the annular space 14. As a result, the vertical duct 3 and steel 22 are very efficiently cooled, at a low flow rate of cooling liquid.

Of course the flow of cooling liquid can be partly or completely brought about by a suction pump connected to outlet 5.

The device according to the invention can comprise means for modifying geometrical characteristics such as the width "e" of the annular space 14 or the diameter of passages 19 or tubes 20, in dependence on the desired flow speeds in each particular application.

Adjusting means can also be provided for modifying the flow rate of the cooling liquid in dependence on the cooling required in each particular application.

By way of example, steel containing 0.8% C. was cast at a flow rate of 4.8 kg/s, using a device as illustrated in FIG. 1. The temperature of the steel in the nozzle was 1510° C.. The steel was cast on to a refractory-material distributing plate and then along the inner wall of a vertical cylindrical copper duct 3, 350 mm long and 220 mm diameter. Duct 3 was cooled with water introduced at ambient temperature and flowing at a rate of 27 $m^3/h$. The pressure drop in the cooling device was 3.5 $kg/cm^2$. A cooling flux density of 4.2 $MW/m^2$ was obtained, the temperature of the water rising by 7° C..

By comparison, similar cooling in a conventional device, by flow of water in a laminar film, required a flow rate of 60 $m^3/h$ of water, the pressure drop was 12 $kg/cm^2$ and the cooling flux density was 3 $MW/m^2$.

The device according to the invention can therefore be used for more efficient cooling with a smaller quantity of cooling liquid and at a lower pressure than in the prior-art devices.

The device can also be constructed in one piece or can be made up of a number of independent or non-independent components disposed around the vertical duct, without thereby departing from the scope of the invention.

The preceding description has mainly disclosed and illustrated a device in which the vertical duct 3 is a circular cylinder. The invention, however, is not limited to this kind of vertical duct but also extends to a duct having a larger outlet cross-section than inlet cross-section, or a duct having a cross-section not circular but e.g. oval.

The present description refers particularly to the cooling of a vertical duct in front of a continuous-casting mould. Of course, without departing from the scope of the invention, an aforementioned device can be used for cooling the continuous-casting mould proper, or any other mould or ingot mould requiring cooling.

We claim:

1. In a continuous casting assembly of the type including a dispenser and a mold, a device intermediate said dispenser and mold for cooling a metal during casting having a vertical duct and means for distributing metal over the inner surface of the vertical duct and disposed substantially at the inlet thereof, the improvement comprising a supply chamber disposed around the vertical duct and having a front wall which at a spacing intimately follows the shape of the vertical duct, an evacuation chamber disposed around the supply chamber, an intermediate wall separating the evacuation chamber from the supply chamber, a rear wall surrounding the evacuation chamber, the front wall having a plurality of first and second passages therethrough, said first and second passages each including passages disposed in a plurality of locations spaced about said duct as well as a plurality of locations spaced along said duct intermediate the opposite ends thereof, said first passages each having an end opening toward the vertical duct, and another end opening into the supply chamber, said second passages each having a tube connected to one end thereof,the tubes extending through the supply chamber and the intermediate wall and opening into the evacuation chambers, means for supplying cooling liquid to the supply chamber, and means for evacuating the cooling liquid from the evacuation chamber.

2. The cooling device of claim 1, wherein the first and second passages in the front wall of the supply chamber open into the spacing between the front wall and the vertical duct in a direction perpendicular to the inner surface of the vertical duct.

3. The cooling device of claim 1 wherein said passages are uniformly distributed in the front wall.

4. In a continuous casting assembly of the type including a dispenser and a mold, a device intermediate said dispenser and mold for cooling a metal during casting having a vertical duct and means for distributing metal over the inner surface of the vertical duct and disposed substantially at the inlet thereof, the improvement comprising a supply chamber disposed around the vertical duct and having a front wall which at a spacing intimately follows the shape of the vertical duct, an evacuation chamber disposed around the supply chamber, an intermediate wall separating the evacuation chamber from the supply chamber, a rear wall surrounding the evacuation chamber, the front wall having a plurality of first and second passages directed towards the vertical duct, the first passages opening into the supply chamber, tubes connected to the second passages, the tubes extending through the supply chamber and the intermediate wall and opening into the evacuation chambers, means for supplying cooling liquid to the supply chamber, means for evacuating the cooling liquid from the evacuation chamber, the means for supplying cooling liquid comprising a distribution chamber disposed around the vertical duct and communicating with the supply chamber via channels distributed around the vertical duct, said supply chamber and said distribution chamber having at least one common wall portion and said channels being formed in the common wall portion.

* * * * *